US005312095A

United States Patent [19]

Rennie

[11] Patent Number: 5,312,095

[45] Date of Patent: May 17, 1994

[54] JOIST HANGAR INSTALLATION TOOL

[76] Inventor: Robert J. Rennie, 2517 Huntington La., Redondo Beach, Calif. 90278

[21] Appl. No.: 27,396

[22] Filed: Mar. 8, 1993

[51] Int. Cl.[5] ..... B25B 5/14

[52] U.S. Cl. ..... 269/41; 269/46; 269/904

[58] Field of Search ..... 248/339, 327, 354.4, 248/495, 340; 269/41, 76, 904, 46; 29/271, 281.1, 281.5, 281.6

[56] References Cited

U.S. PATENT DOCUMENTS

| | | | |
|---|---|---|---|
| 603,940 | 5/1898 | Carkin | 248/340 |
| 1,026,622 | 5/1912 | Blount | 248/339 |
| 3,067,995 | 12/1962 | Milam | 269/76 |
| 4,159,029 | 6/1979 | Matthews | 269/904 |
| 4,973,021 | 11/1990 | Schuite | 248/327 |
| 5,054,755 | 10/1991 | Hawkes | 269/41 |

*Primary Examiner*—Robert C. Watson

[57] ABSTRACT

A tool for the carpenter or welder in the building industry. The tool quickly and accurately places joist hangars, which are used to fasten and support joists. The tool frees the users hands while holding the hangar in its proper position. Gravity holds the tool and joist hangar combination plumb. The flanges (4) on the tool body (1) engage the flanges on the hangar in proper configuration. The tool has a centered, adjustable sliding support hook which is bent to hook over the top of the beam and slide vertically through the body. The adjustable sliding support hook(2) is secured by a hand operated set screw(3), which is threaded into the body(1). The joist hangar slides into the tool easily. When the joist hangar is nailed or welded, the tool slides off of the installed joist hangar just as easily. The tool can be made in appropriate sizes for different joist hangars. This tool can be fabricated, cast, or injection molded from either metal or plastic.

1 Claim, 3 Drawing Sheets

JOIST HANGAR INSTALLATION TOOL

This invention relates to a tool for installing joist hangers onto the supporting beams during the framing stage of construction.

This invention has been made independent of any government or any other company, organization or individual. This invention has been made solely by myself, Robert J. Rennie.

BACKGROUND OF THE INVENTION

This invention embodies a labor saving device for the quick and proper installation of joist hangers which, in turn, are used to secure joists in their proper relationship to the supporting structure of a building.

The Hawkes tool, U.S. Pat. No. 5,054,755 install joist hangers properly, even under ideal conditions. Unless the carpenter or steel worker first notches the bottom of the joist, Hawkes, bottom flange causes the joist to be mounted too high because the hanger is pushed up into the space where the joist itself should be. If the flange in question was removed from the Hawkes tool to allow proper installation of the joist hanger, the means for holding the tool to the beam would be lost and the tool would fall off the beam due to improper weight distribution.

Due to lumber shrinkage and the difference in lumber dimensions from mill to mill, and indeed, from batch to batch, the necessity of an adjustable tool is indicated.

A user would need an infinite number of Hawkes' tools. In the field, we often must install joists either high or low on a beam (perhaps 2×8 joists to a 4×12 beam) which further indicates the necessity for an adjustable tool. Indeed, the likelihood of any beam being the exact dimension of a batch of joists is small.

The Hawkes tool has no means to engage the side flanges of a joist hanger. This portion of a hanger must be held in proper configuration to insure plumb mounting of joists. Joist hangers are shipped nested from the manufacturers and must be bent and held by hand to their proper shape while being nailed or welded. Therefore, the Hawkes tool does not provide a hands free operation as claimed.

SUMMARY OF THE INVENTION

This tool solves the problems of all previous methods of installing joist hangers and, accordingly, I claim the following as my objects and advantages of the invention:

To provide an adjustable tool for easily, quickly and accurately installing joist hangers. To provide such a tool which will free the users hands aligning the joist hanger to the supporting beam, and to provide such a tool that will hold the joist hanger in its proper width, height and configuration. Furthermore, I claim the following additional objects and advantages:

The tool will hold the joist hanger plumb by the force of gravity.

The tool will place the joist hanger so that the joist will be in any position needed, whether it be flush to the top, flush to the bottom, or with a reveal in relation to the beam.

The tool eliminates the need for layout lines on the beam.

The tool eliminates the need to see the layout lines and thus, the user can work from above or below.

The user's hands are also free to drive the nails or weld.

The tool needs no fasteners or clamps as it is suspended by the adjustable sliding support hook.

The tool is adjustable for different lumber sizes and height discrepancies.

The tool can be adjusted without a measuring device

Repeatability is exact, ensuring all joists will be flush with one another and the beam.

The tool can be fabricated, cast, or injection molded

LIST OF REFERENCE NUMERALS

Figure 1:
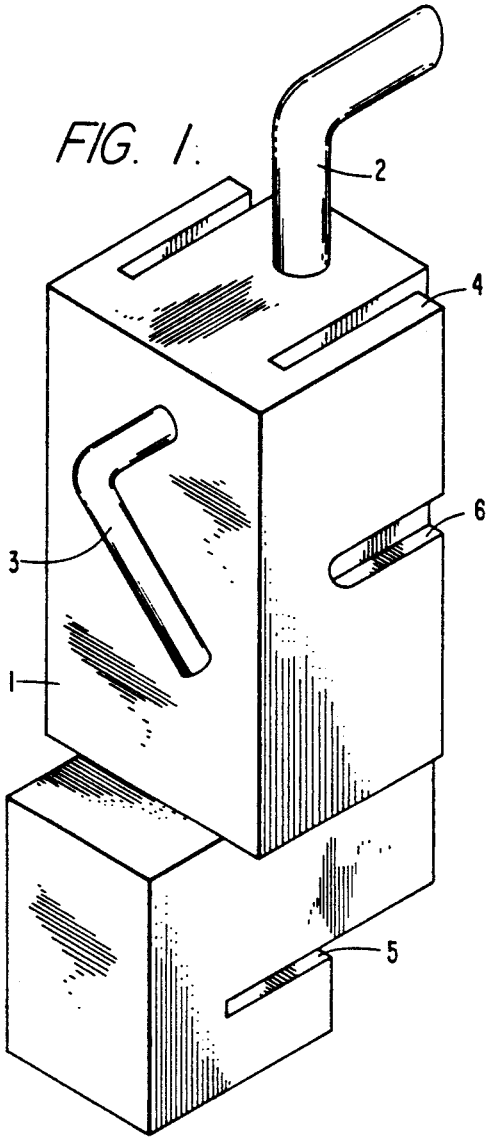
FIG. 1 is a perspective view of my invention showing the assembled relationship of the three parts. Part #1, the body of the tool, engages the joist hanger by means of its side flanges (4) and bottom slot (5). Part #2 is the adjustable sliding support hook. Part #3 is the set screw which secures the adjustable sliding support hook (2) into position.

1. Main body of the tool
2. Adjustable sliding support hook
3. Set Screw
4. Side flanges of the maid body of the tool
5. Bottom slot for accepting the bottom flange of the joist hanger.
6. Slot for side barb on some joist hangers.

DESCRIPTION OF THE PREFERRED

This invention is a tool comprised of three parts. Part 1, FIG. 1 in the drawings is the main body of the tool. This body can be fabricated of component pieces; it can be made of metal or plastic. The tool must have the following features:

Its body width must engage the joist hanger properly;

The body must have flanges (4) on its sides to engage the side flanges on a joist hanger.

These side flanges (4) on the body must be recessed to allow the face of the body (1) to touch the supporting beam with a joist hanger engaged.

The body (1) must also have a bottom slot (5) to engage the bottom flange of a joist hanger.

The side flanges (4) of the body (1) have slots (6) to allow barbs, which are on some joist hangers, to clear the tool when a joist hanger is slid into the tool.

The body also has a vertical hole centered between the sides which run from top to bottom through the body (1). This hole is close to the front face of the body (1) . This hole is where the adjustable sliding support hook (2) slides up and down in the body(1). The body(1) also has a horizontal hole towards the top of the body (1) which is centered from the sides of the body (1). This hole is threaded to accept the set screw (3) which screws into the back of the tool (see FIGS. 1 and 2).

The adjustable sliding support hook (2) has a 90 degree bend at the top end which extends far enough forward to support the tool from the top of a beam. The vertical portion of the adjustable sliding support hook (2) must be long enough to be secured by the set screw (3) and extend high enough to hook over the beam and support the tools.

The only critical dimension of this tool is the main body (1) width, which is determined by which specific joist hanger is used. The other dimensions can be determined by the joist hanger to be installed.

Figure 2:
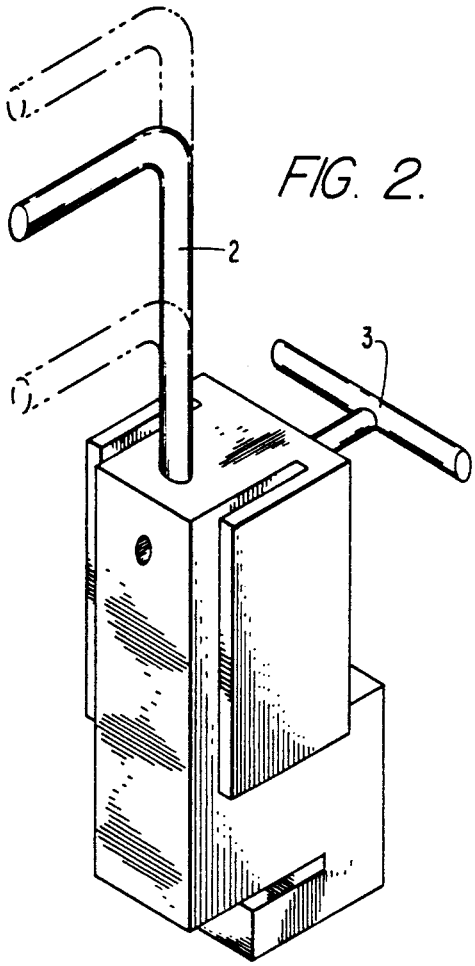
FIG. 2 is a perspective view of my invention which shows the tool from a different angle. This view shows more clearly the relationship of the side flanges (4) and some possible different positions of the adjustable sliding support hook (2), which can be of flat stock or round stock.
Figure 9:
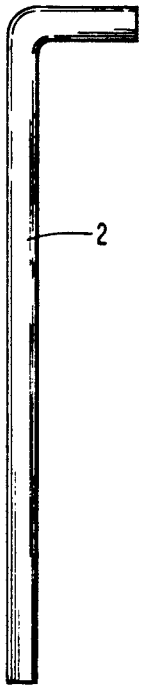
FIG. 9 is a side view of a removed adjustable sliding support hook(2).
Figure 3:
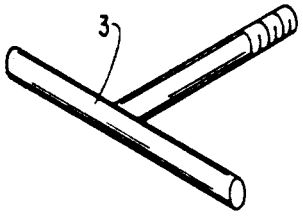
FIG. 3 shows Part #3, the set screw, removed to show the threaded end.
Figure 4:
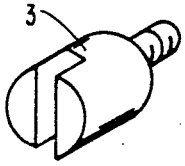
FIG. 4 is a perspective view showing an alternate set screw (3) which can be tightened with a hammer claw and has the advantage of not being in the way of hammer blows.

The set screw (3) is the last part of only three parts that make up the complete tool assembly. The set screw threads into the back of the body (1) and secures the adjustable sliding support hook (2). This part is shown in three different styles in FIGS. 1, 2, 3 AND 4. FIGS. 1, 2 and 3 show finger operable samples. FIG. shows a sample that can be tightened with a hammer claw.

OPERATION OF THE INVENTION

To utilize the tool, it must first be adjusted to accommodate the vertical heights of the supporting beam and joist when installed. This will, in most cases, be accomplished by following these steps:

A. Loosen the set screw (3).

B. Lay tool face down on the side of a joist perpendicular to its length.

C. Slide the bottom edge of the body (1) adjacent to one edge of the joist.

D. Slide the adjustable sliding support hook (2) so that it is touching the opposite edge of the joist.

E. Tighten the set screw (3).

Figure 5:
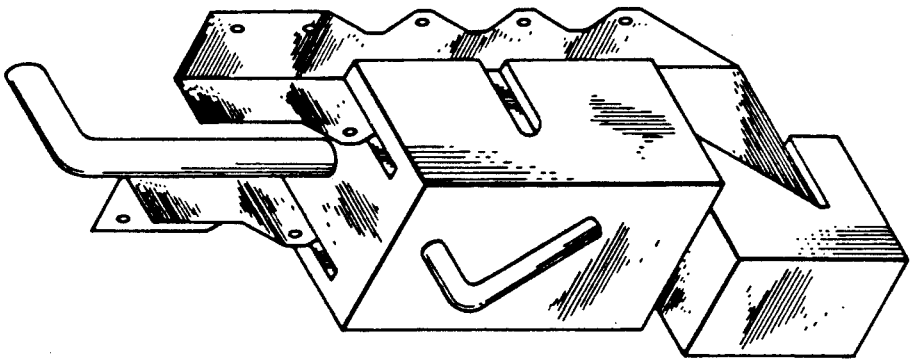
FIG. 5 is a perspective view of my invention showing a joist hanger snapped onto the tool.
Figure 8:
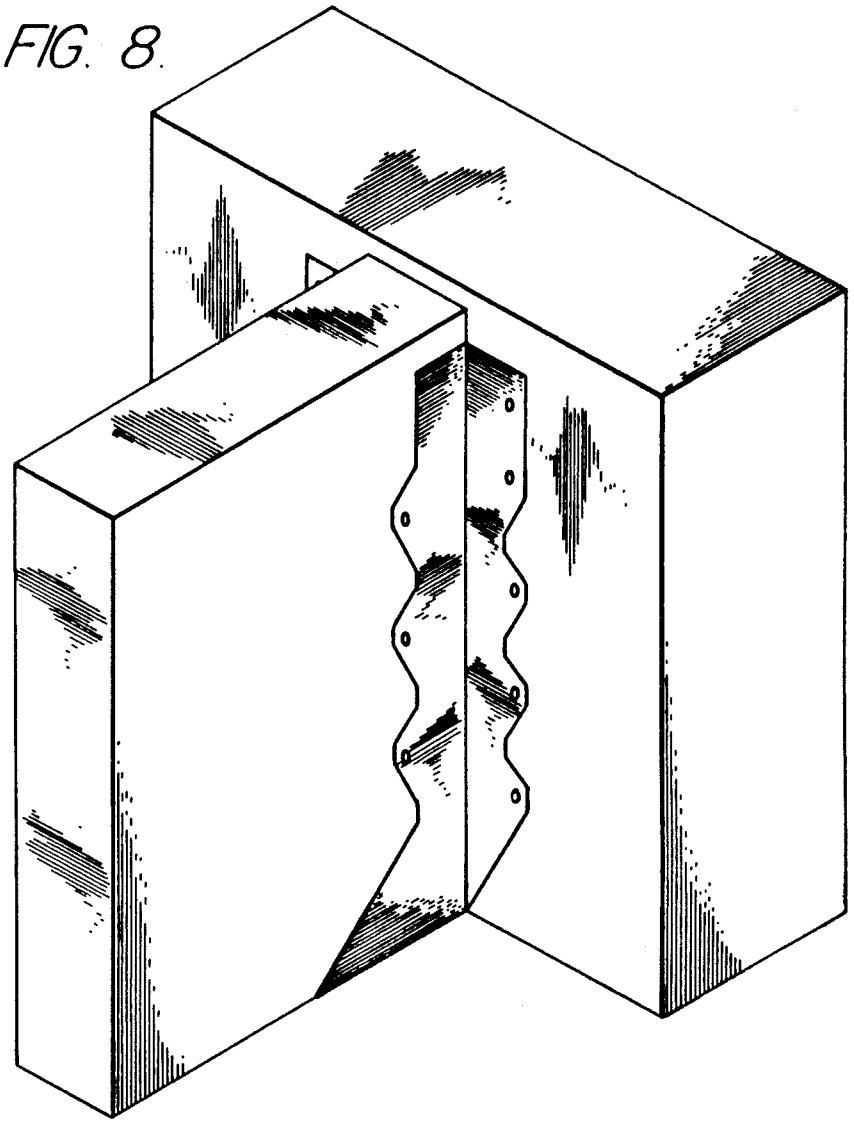
FIG. 8 is a perspective view of a joist set into the properly installed joist hanger.
Figure 7:
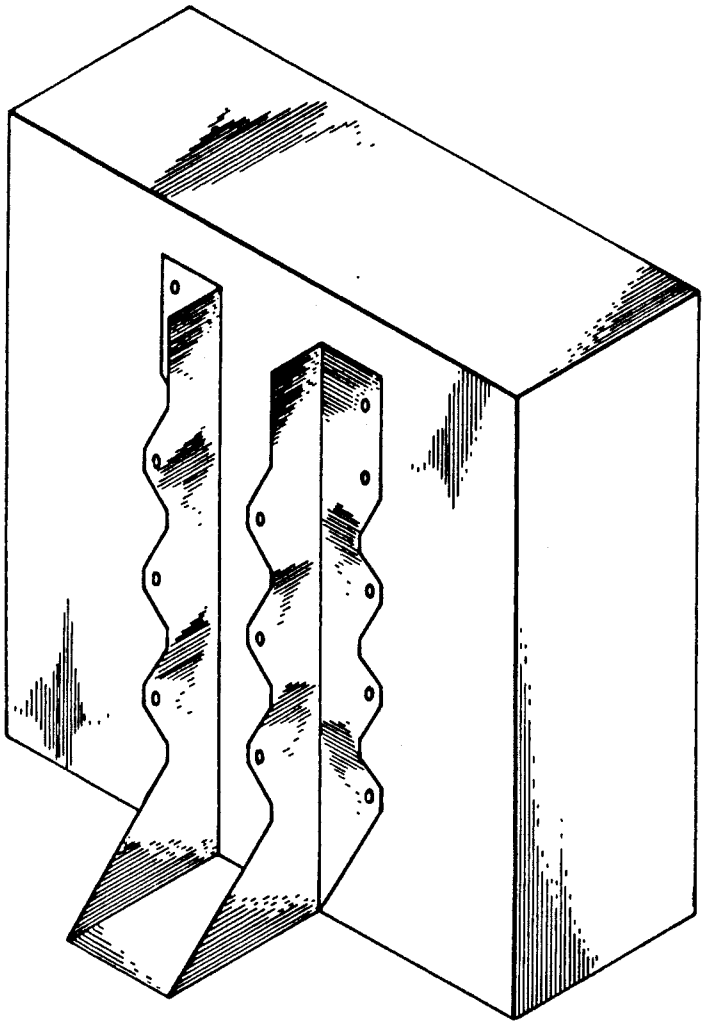
FIG. 7 is a perspective view of the installed joist hanger with the tool removed.

This adjustment should only take five or ten seconds. Unusual situations can be accommodated with adjustments or a longer adjustable sliding support hook. At this point, the tool will install joist hangers with perfect repeatability and alignment of all similar sized material. So;

Snap the joist hanger onto the tool as in FIG. 5

Figure 6:
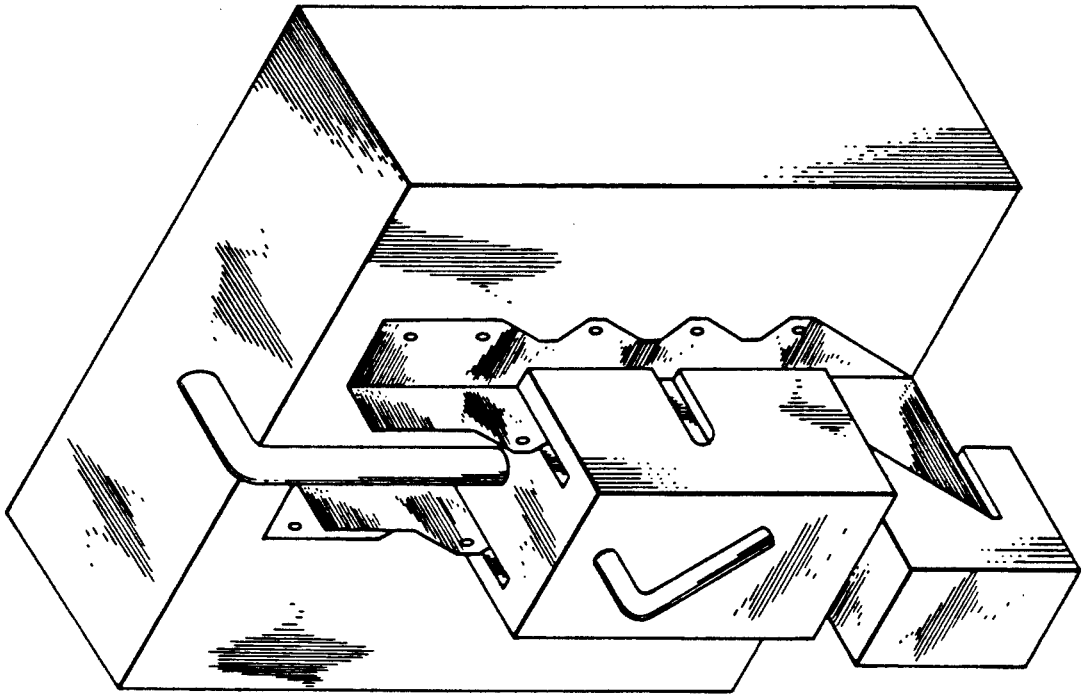
FIG. 6 is a perspective view of my invention showing the tool with a joist hanger snapped in and hanging on a supporting member.

Hang the tool with the joist hanger in it on the beam as in FIG. 6.

Install nails or weld hanger to beam

Remove tool from installed joist hanger by sliding it off, leaving a perfectly installed joist hanger.

Repeat

These operations in the field are accomplished with speed and aplomb.

What is claimed is:

1. An adjustable tool for the installation of joist hangers to the supporting structure of a building, comprising the combination of, (a) a body of the same nominal width as the joist to be installed, and of a height no more than that of the smallest joist to be installed, said body having bottom and side flanges attached to the rear of said body and extending forward towards the face of said body only far enough to engage the bottom and side flanges of a joist hanger, allowing the face of said body to touch the supporting structure at the point of installation with a joist hanger engaged, and said body also having slots in said side flanges so arranged to allow barbs on a joist hanger to enter, and said body also having a vertical hole centrally located from the sides of said body to allow a vertical rod to enter, and said body also having a horizontal intersecting threaded hole extending rearward perpendicularly from the vertical hole to accept a set screw, and (b) a vertical rod with a 90 degree bend at the top to extend forward over the top of the supporting structure, the vertical leg of said rod extending downwards through said vertical hole in said body, and (c) a set screw means received in said horizontal threaded hole to secure said vertical rod to said body.

* * * * *